US009926934B2

(12) United States Patent
Kölscheid et al.

(10) Patent No.: US 9,926,934 B2
(45) Date of Patent: Mar. 27, 2018

(54) ARRANGEMENT FOR LIQUEFYING NATURAL GAS AND METHOD FOR STARTING SAID ARRANGEMENT

(75) Inventors: Hans-Gerd Kölscheid, Duisburg (DE); Klaus Peters, Mülheim (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1615 days.

(21) Appl. No.: 13/375,821

(22) PCT Filed: Jun. 1, 2010

(86) PCT No.: PCT/EP2010/057640
§ 371 (c)(1),
(2), (4) Date: Feb. 13, 2012

(87) PCT Pub. No.: WO2010/142574
PCT Pub. Date: Dec. 16, 2010

(65) Prior Publication Data

US 2012/0131950 A1 May 31, 2012

(30) Foreign Application Priority Data

Jun. 9, 2009 (DE) ..... 10 2009 024 407

(51) Int. Cl.
*F25J 1/02* (2006.01)
*F04D 25/02* (2006.01)
(Continued)

(52) U.S. Cl.
CPC ..... *F04D 25/02* (2013.01); *F01K 13/02* (2013.01); *F04D 25/04* (2013.01); *F04D 25/06* (2013.01);
(Continued)

(58) Field of Classification Search
CPC ..... F25J 1/0022; F25J 1/0213; F25J 1/0283; F25J 1/029; F25J 1/02; F25J 1/0205;
(Continued)

(56) References Cited

U.S. PATENT DOCUMENTS 1,880,066 A * 9/1932 Barnes ..... 74/339
2,550,844 A * 5/1951 Meiller et al. ..... 48/190
(Continued)

FOREIGN PATENT DOCUMENTS

CH 76249 A 11/1914
CN 101014760 A 8/2007
(Continued)

OTHER PUBLICATIONS

EP1903189 Translation.*
(Continued)

*Primary Examiner* — Frantz Jules
*Assistant Examiner* — Brian King

(57) ABSTRACT

An arrangement for liquefying natural gas is provided. The arrangement includes a gas turbine unit that includes a gas turbine compressor, a steam turbine unit, a first compressor unit, a shiftable clutch, a heated steam generator for supplying steam to the steam turbine unit, and a second compressor unit. The steam turbine unit and the first compressor unit have a common, rigidly connected first shaft assembly, while the gas turbine unit and the second compressor unit have a common, rigidly connected second shaft assembly. In order to increase economic efficiency, the first shaft assembly and the second shaft assembly are operable to be connected to and disconnected from each other using the clutch. A suitable method for starting said arrangement is also provided.

13 Claims, 2 Drawing Sheets

(51) Int. Cl.

| | |
|---|---|
| ***F01K 13/02*** | (2006.01) |
| ***F04D 25/04*** | (2006.01) |
| ***F04D 25/06*** | (2006.01) |
| ***F04D 27/02*** | (2006.01) |
| ***F25J 1/00*** | (2006.01) |

(52) U.S. Cl.
CPC ..... *F04D 27/0292* (2013.01); *F25J 1/0022* (2013.01); *F25J 1/0205* (2013.01); *F25J 1/029* (2013.01); *F25J 1/0214* (2013.01); *F25J 1/0242* (2013.01); *F25J 1/0269* (2013.01); *F25J 1/0282* (2013.01); *F25J 1/0283* (2013.01); *F25J 1/0289* (2013.01); *F25J 1/0298* (2013.01); *F25J 2230/20* (2013.01); *F25J 2240/82* (2013.01); *F25J 2280/10* (2013.01)

(58) Field of Classification Search
CPC .... F25J 1/0242; F25J 2280/10; F25J 2230/20; F25J 2240/82
USPC ..... 62/606, 611, 613
See application file for complete search history.

(56) References Cited

U.S. PATENT DOCUMENTS

| | | | | |
|---|---|---|---|---|
| 3,964,891 | A * | 6/1976 | Krieger | 62/612 |
| 4,359,871 | A | 11/1982 | Strass | |
| 6,952,926 | B2 * | 10/2005 | Blatter et al. | 60/778 |
| 7,526,926 | B2 | 5/2009 | Rasmussen et al. | |
| 2006/0042259 | A1 | 3/2006 | Marushima et al. | |
| 2008/0289337 | A1 * | 11/2008 | Marushima et al. | 60/722 |

FOREIGN PATENT DOCUMENTS

| | | | |
|---|---|---|---|
| DE | 1601527 | A1 | 2/1970 |
| DE | 3316070 | A1 | 11/1984 |
| DE | 3907217 | A1 | 9/1990 |
| DE | 19757588 | A1 | 7/1998 |
| EP | 0768449 | A1 | 4/1997 |
| EP | 1903189 | A1 | 3/2008 |
| WO | WO 0233226 | A1 | 4/2002 |
| WO | WO 2008139535 | A1 | 11/2008 |

OTHER PUBLICATIONS

Ullmann's Encyclopedia of Industrial Chemistry, Naphthalene to nuclear Technology, vol. A17; VCH Verlagsgesellschaft mbH; in: Weinheim; 5te Auflage; 1991; pp. 100-105.

Ullmann's Encyclopedia of Industrial Chemistry, Unit Operations II, vol. B3; VCH Verlagsgesellschaft mbH; in: Weinheim; 5te Auflage; 1988; pp. 20-11.

Ullmanns Encyclopedia of Industrial Chemistry, Dentalchemie bis Erdölverarbeitung, Band 10; Verlag Chemie GmbH; in: Weinheim; 4te Auflage; 1975; pp. 581-604.

"Gas Turbine and Gas-Steam Combined Cycle Arragement", Power Machinery and Engineenng Institute of Department of Thermal Engineering of Tsinghua University, pp. 306-309, China Electric Power Press, 2007, CN.

* cited by examiner

ARRANGEMENT FOR LIQUEFYING NATURAL GAS AND METHOD FOR STARTING SAID ARRANGEMENT

CROSS REFERENCE TO RELATED APPLICATIONS

This application is the US National Stage of International Application No. PCT/EP2010/057640, filed Jun. 1, 2010 and claims the benefit thereof. The International Application claims the benefits of German application No. 10 2009 024 407.7 filed Jun. 9, 2009. All of the applications are incorporated by reference herein in their entirety.

FIELD OF INVENTION

The invention relates to an arrangement for liquefying natural gas with a gas turbine unit, a steam turbine unit and compressors. The invention also relates to a method for starting such an installation.

BACKGROUND OF INVENTION

The liquefaction of natural gas is gaining in importance as raw materials become scarce and there is increasing environmental awareness. In many cases, natural gas represents a more environmentally friendly, safer and sometimes more readily available alternative to other sources of energy. However, gas has the disadvantage that transportation and storage can be very costly, and can be carried out more expediently in the liquid state. Accordingly, installations for liquefying natural gas are also gaining in importance.

Conventional installations for liquefying natural gas usually comprise one or two compressors or compressor casings that are driven by at least one gas turbine or a motor. These liquefied natural gas installations with a high annual production (5 to 10 MPTA) normally use what are known as single-shaft gas turbines, in which the gas turbine compressor and the turbine of the gas turbine are located on a shaft assembly. These single-shaft gas turbines are not capable of starting independently or starting at nominal speed, and to do so often require a starter-helper motor. This starter-helper motor is often also used for supporting the gas turbine when there are high power requirements. The operation of this motor requires high-voltage power electronics, which are designed for power outputs of approximately 40 MW in a relatively large installation.

SUMMARY OF INVENTION

Proceeding from the installation described above, the invention is based on the object of providing a simplified installation concept, without losses in overall efficiency having to be accepted, so that reduced investment costs are obtained.

The invention is based on the features of the independent claims. The dependent claims contain advantageous developments of the invention.

In the terminology of the patent application, the gas turbine unit also comprises a gas turbine compressor assigned to it. Furthermore, gas turbine units, steam turbine units and compressor units mean one or more machines of this corresponding machine type that can be arranged in parallel or in series with one another. What is important about the units is that corresponding process fluid originates from a common stream and, after passing through the corresponding unit, also forms a common stream again, possibly converging when it enters such a stream.

The invention makes it possible for the arrangement to use the steam turbine on the one hand as a replacement for an electric starter-helper motor for the gas turbine and on the other hand as a drive for a compressor of the liquefying installation. This makes it possible to dispense with the electric starter-helper motor for starting, and possibly supporting, the gas turbine, and with it also the very complex and costly high-voltage frequency converter. At the same time, a high efficiency is obtained, in particular since the disconnection of the clutch allows the gas turbine and the steam turbine to be controlled separately.

In addition, the efficiency of the arrangement can be significantly increased if, by means of a waste heat recovery boiler, the waste gas of the gas turbine is used for generating steam for the steam turbine. The two shaft assemblies, the first shaft assembly of the steam turbine and the second shaft assembly of the gas turbine, are in themselves rigidly formed and cannot be disconnected by means of a shiftable clutch. However, this does not rule out releasable fastenings—for example by means of bolts—along the extent of these shaft assemblies. The shiftable clutch between the first shaft assembly and the second shaft assembly allows the gas turbine to be started with the aid of the steam turbine as provided by the invention. In the case where the invention is formed with a waste heat recovery steam generator, the power output of the fired steam generator is preferably replaced step by step by steam from the waste heat recovery steam generator, preferably until the fired steam generator is switched off completely. When there are special power requirements, the fired steam generator can additionally provide steam for the steam turbine. The first shaft assembly and/or the second shaft assembly may possibly be connected to a generator for generating power.

The particular suitability of the arrangement according to the invention for operating a natural gas liquefying installation is evident when the first compressor unit is in connection with a first heat exchanger of a first stage of the cooling down of the natural gas and the second compressor unit is correspondingly in connection with a second stage at a lower temperature level than the first stage. In this way, the first stage of the gas liquefaction can be initially brought to an operating temperature of, for example, −40° C., before the gas turbine is started by means of the steam turbine.

The second compressor unit is expediently formed with two compressors, a low-pressure compressor and a high-pressure compressor, these being arranged in series in such a way that the outlet pressure from the low-pressure compressor substantially corresponds to the inlet pressure of the high-pressure compressor apart from any pressure losses in modules arranged in between.

During starting before the engagement of the gas turbine to the first shaft assembly of the steam turbine, it is expedient if the gas turbine is already turned at a low turning speed (of about up to 150 revolutions per minute) by means of a turning motor and the steam turbine is operated at just below this speed before the engagement, so that the shiftable clutch is not overloaded.

A turning motor is not comparable with a starter-helper motor in terms of its power consumption because of the relatively low speed.

BRIEF DESCRIPTION OF THE DRAWINGS

The invention is explained in more detail below on the basis of a specific exemplary embodiment, without being restricted to this example, with reference to drawings, in which.

DETAILED DESCRIPTION OF INVENTION

Figure 1:
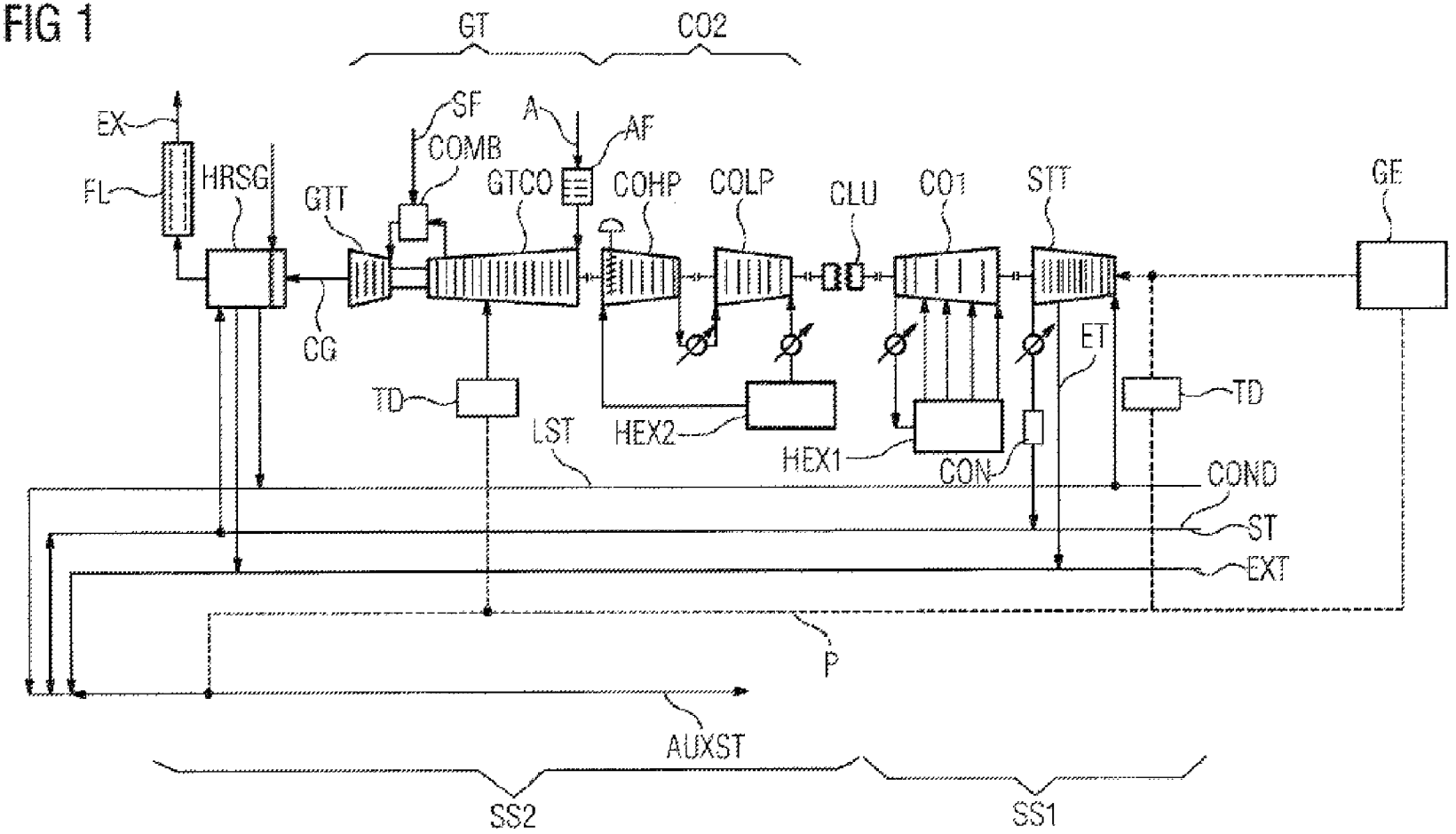
FIG. 1 shows a schematic representation of an arrangement according to the invention.
Figure 2:
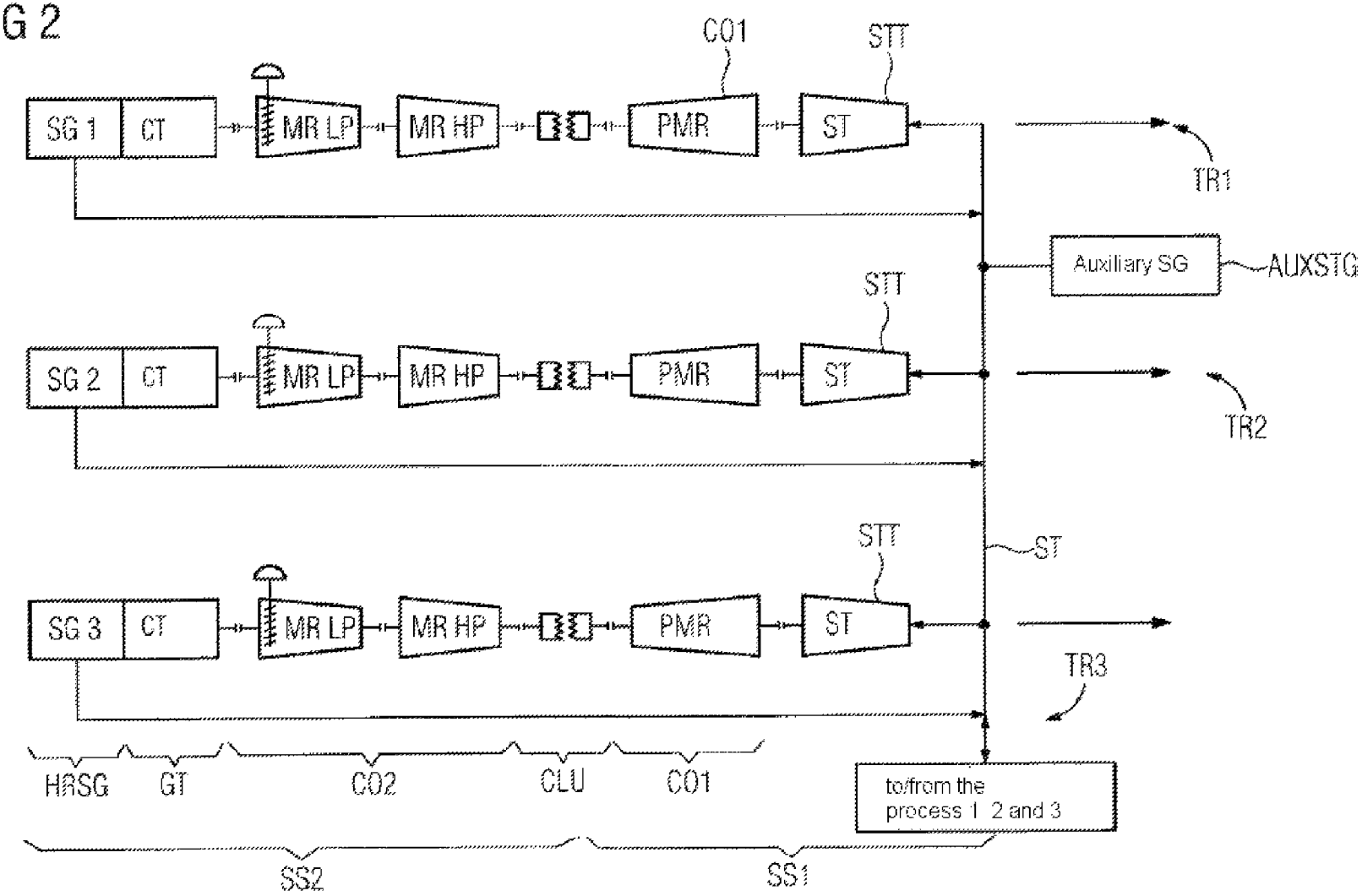
FIG. 2 shows a schematic representation of a number of arrangements according to the invention, which are operated in parallel with one another.

FIG. 1 shows an arrangement TR according to the invention in a schematic representation of the method, comprising a first shaft assembly SS1 and a second shaft assembly SS2. The two shaft assemblies SS1, SS2 can be connected to each other by a shiftable clutch CLU. FIG. 2 shows a parallel connection of three arrangements TR1, TR2, TR3 according to the invention. The conducting of steam ST and condensate COND is represented in both figures.

The arrangement TR, TR1, TR2, TR3 according to the invention respectively comprises a steam turbine STT and a first compressor unit CO1 on a common first shaft assembly SS1 and a gas turbine GT and a second compressor unit CO2 on a second shaft assembly SS2. The second compressor unit CO2 comprises a low-pressure compressor COLP and a high-pressure compressor COHP. The first compressor unit CO1 is represented here by just a compressor casing. The cooling process, not shown any more specifically, of the liquefying installation with the heat exchangers HEX1, HEX2 is of a two-stage form, the first stage with the first heat exchanger HEX1 being supplied by the first compressor unit CO1 and the second stage of the liquefying installation with the second heat exchanger HEX2 being supplied by the second compressor unit CO2.

The gas turbine GT has its own gas turbine compressor GTCO, by means of which ambient air A is sucked in through an air filter AF, mixed with fuel F and burned in a combustion chamber COMB before the generated combustion gas CG is allowed to expand downstream in a gas turbine turbine. The gas turbine turbine GTT drives both the gas turbine compressor GTCO and the second compressor unit CO2. After expansion, the hot combustion gas CG reaches a waste heat recovery heat exchanger HRSG and is cooled down there to generate steam, before it is released into the surroundings through an exhaust gas filter FL as purified exhaust gas EX, is put to some other use or is stored. The steam turbine STT receives live steam LST from the waste heat recovery steam generator HRSG, and the steam ST that has expanded in the steam turbine STT is precipitated in a condenser CON and returned as condensate COND to the waste heat recovery steam generator HRSG to generate live steam LST. Extraction steam EXT is also removed from the steam turbine STT by means of an extraction point ET. Both the steam turbine STT and the gas turbine GT are kept at a low speed, for example during downtimes, for example between 100 and 150 revolutions per minute, by means of a turning drive TD, in order that the shaft does not become distorted as it cools down. Optionally, a generator GE, which generates electrical power P, may be connected to the steam turbine STT. For starting the steam turbine STT, auxiliary steam AUXST is provided, originating either from arrangements TR operated in parallel or from a fired steam generator AUXSTG. FIG. 2 shows this in the parallel arrangement with the fired steam generator AUXSTG.

The arrangement TR, TR1, TR2, TR3 is in each case run up as follows:

Steam ST for running up the steam turbine STT with the first compressor unit CO1 is generated in the fired steam generator AUXSTG. At this point in time, the first shaft assembly SS1 is not coupled to the second shaft assembly SS2, on which the gas turbine GT and the second compressor unit CO2 are located. The second shaft assembly SS2 is slowly turned by means of the turning drive TD at a turning speed of between 100 and 150 revolutions per minute. With the aid of the auxiliary steam. AUXST, the steam turbine of the first compressor unit CO1 is slowly run up to operating speed, while taking into consideration the necessary holding points. When the operating speed and the operating temperature have been reached, the first heat exchanger HEX1, which is in connection with the first compressor unit CO1, is lowered in temperature to the process requirements adapted to the liquefying process. Subsequently, the speed of the first shaft assembly SS1 is lowered below the turning speed of the second shaft assembly SS2 and the clutch CLU is engaged. The preheated steam turbine then takes the entire shaft assembly to operating speed, the gas turbine GT being ignited. As soon as the gas turbine GT generates sufficient power to drive the second compressor unit CO2, the speed of the first shaft assembly is lowered slightly below the speed of the second shaft assembly and the clutch CLU is disengaged, so that the two assemblies can be controlled separately from each other. Step by step, the steam required for the steam turbine STT from the fired steam generator AUXSTG is changed over to the steam ST from the waste heat recovery steam generator HRSG.

The invention claimed is:

1. An arrangement for liquefying natural gas, comprising:
- a gas turbine unit comprising a gas turbine compressor,
- a steam turbine unit,
- a first compressor unit,
- a shiftable clutch,
- a fired steam generator for supplying the steam turbine unit with steam , and
- a second compressor unit,
- wherein the steam turbine unit and the first compressor unit have a common, rigidly connected first shaft assembly,
- wherein the gas turbine unit and the second compressor unit have a common rigidly connected second shaft assembly, and
- wherein the first shaft assembly and the second shaft assembly are operable to be connected to and disconnected from each other via the clutch.

2. The arrangement as claimed in claim 1, wherein the second shaft assembly is without an electric starter-helper motor.

3. The arrangement as claimed in claim 1, wherein the first compressor unit is connected to a first heat exchanger, via which the natural gas is cooled down to a first temperature.

4. The arrangement as claimed in claim 3, wherein the second compressor unit is connected to a second heat exchanger, via which the natural gas is cooled down to a second temperature, which is lower than the first temperature.

5. The arrangement as claimed in claim 1, wherein the second compressor unit has a low-pressure compressor and a high-pressure compressor and compressed natural gas is conducted from the low-pressure compressor into the high-pressure compressor.

6. The arrangement as claimed in claim 1, further comprising a generator in connection with the steam turbine to generate power.

7. The arrangement as claimed in claim 1, further comprising a waste heat recovery steam generator for generating steam for the steam turbine by via a combustion gas from the gas turbine.

8. A method for starting an arrangement according to claim 1, the method comprising:

generating steam in the fired steam generator, starting the steam turbine to an operating speed, operating the first compressor until a first heat exchanger for cooling down the natural gas has reached a first operating temperature, and engaging the clutch and igniting the gas turbine.

9. The method as claimed in claim 8, further comprising changing over the supply of steam to the steam turbine with steam from a waste heat recovery steam generator that is operated with a combustion gas of the gas turbine, from being supplied to the steam turbine from the fired steam generator, the changeover taking place step by step after the ignition of the gas turbine.

10. The method as claimed in claim 8, wherein the gas turbine is turned at a turning speed by a turning drive before the engagement of the clutch.

11. The method as claimed in claim 8, wherein the speed of the steam turbine is lowered before the engagement of the clutch.

12. The method as claimed in claim 11, wherein the lowering of the speed of the steam turbine before the engagement of the clutch takes place to below a turning speed.

13. The method as claimed in claim 8, comprising operating the clutch for disconnecting the first shaft assembly from the second shaft assembly once the two shaft assemblies have reached the operating speed.

* * * * *